US008629605B2

(12) United States Patent
Katsuraya et al.

(10) Patent No.: US 8,629,605 B2
(45) Date of Patent: Jan. 14, 2014

(54) SPARK PLUG HAVING SHAPED INSULATOR

(75) Inventors: Kohei Katsuraya, Nagoya (JP); Hiroyuki Kameda, Nagakute (JP); Katsutoshi Nakayama, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 198 days.

(21) Appl. No.: 13/266,544

(22) PCT Filed: Apr. 30, 2010

(86) PCT No.: PCT/JP2010/003100

§ 371 (c)(1),
(2), (4) Date: Oct. 27, 2011

(87) PCT Pub. No.: WO2010/128592

PCT Pub. Date: Nov. 11, 2010

(65) Prior Publication Data

US 2012/0038263 A1 Feb. 16, 2012

(30) Foreign Application Priority Data

May 7, 2009 (JP) ..... 2009-112527

(51) Int. Cl.
*H01T 13/20* (2006.01)
*H01T 13/14* (2006.01)

(52) U.S. Cl.
USPC ..... 313/144; 313/143; 313/118

(58) Field of Classification Search
USPC ..... 313/118–145; 123/169 R, 169 EL, 32, 123/41, 310
See application file for complete search history.

(56) References Cited

U.S. PATENT DOCUMENTS

| | | | |
|---|---|---|---|
| 6,091,185 | A | 7/2000 | Matsubara et al. |
| 7,528,534 | B2 | 5/2009 | Kuki et al. |
| 2005/0001526 | A1 | 1/2005 | Burrows |

FOREIGN PATENT DOCUMENTS

| | | | |
|---|---|---|---|
| JP | 60-134290 | U | 9/1985 |
| JP | 62-217589 | A | 9/1987 |
| JP | 06-196247 | A | 7/1994 |
| JP | 10-289777 | A | 10/1998 |
| JP | 2005-510023 | A | 4/2005 |
| JP | 2005-183177 | A | 7/2005 |

OTHER PUBLICATIONS

WO 2005060060; see US 7528534 B2.*

International Search Report mailed on Aug. 3, 2010 for the corresponding PCT application No. PCT/JP2010/003100.

* cited by examiner

*Primary Examiner* — Nimeshkumar Patel

*Assistant Examiner* — Jacob R Stern

(74) *Attorney, Agent, or Firm* — Leason Ellis LLP

(57) ABSTRACT

A spark plug includes a center electrode extending in an axial direction; an insulator formed externally of the outer circumference of the center electrode; a metallic shell formed externally of the outer circumference of the insulator and having a ledge which supports the insulator; and a ground electrode joined to the metallic shell. The insulator has a support portion which faces the ledge. A "frontward direction" is defined as the direction parallel to the axial direction toward a spark portion formed between the center electrode and the ground electrode. The insulator has a diameter reduction portion whose outside diameter reduces along the frontward direction from the support portion, and a diameter increase portion whose outside diameter increases along the frontward direction from the front end of the diameter reduction portion. This restrains the generation of leak current while maintaining heat resistance of the spark plug.

13 Claims, 6 Drawing Sheets

SPARK PLUG HAVING SHAPED INSULATOR

CROSS-REFERENCE TO RELATED PATENT APPLICATIONS

This application is a U.S. National Phase Application under 35 U.S.C. §371 of International Patent Application No. PCT/JP2010/003100, filed Apr. 30, 2010, and claims the benefit of Japanese Patent Application No. 2009-112527, filed May 7, 2009, all of which are incorporated by reference herein. The International Application was published in Japanese on Nov. 11, 2010 as International Publication No. WO/2010/128592 under PCT Article 21(2).

FIELD OF THE INVENTION

The present invention relates to a spark plug.

BACKGROUND OF THE INVENTION

When incomplete combustion of an air-fuel mixture or the like arises within a combustion chamber of an engine, carbon is generated and may accumulate on the surface of an insulator of a spark plug. When the surface of the insulator is covered with carbon, leakage current is generated, and discharge may fail to be generated normally between electrodes (across a spark gap).

A conventionally known technique for restraining leakage current in a spark plug is disclosed in, for example, Japanese Patent Application Laid-Open (kokai) No. 2005-183177.

According to this technique, a portion (hereinafter may be referred to as a "leg portion") of the insulator of the spark plug which is exposed within the combustion chamber is increased in length. This practice increases the surface area of the leg portion; thus, even when carbon adheres to the leg portion, leakage current is unlikely to be generated, thereby improving fouling resistance of the spark plug. Although this technique can improve fouling resistance, it involves a problem in that, since heat fails to smoothly transfer from the insulator to a metallic member, heat resistance of the spark plug deteriorates.

The present invention has been conceived to solve the above-mentioned conventional problem, and an object of the invention is to provide a technique for restraining the generation of leakage current while maintaining heat resistance of a spark plug.

SUMMARY OF THE INVENTION

In order to solve, at least partially, the above problem, the present invention can be embodied in the following modes or application examples.

Application Example 1

A spark plug comprises a center electrode extending in an axial direction; an insulator disposed externally of an outer circumference of the center electrode; a metallic shell disposed externally of an outer circumference of the insulator and having a ledge projecting with a predetermined width toward the insulator; and a ground electrode joined to the metallic shell. When a direction parallel to the axial direction directed toward a spark portion formed between the center electrode and the ground electrode is taken as a frontward direction, and an opposite direction is taken as a rearward direction, the insulator has a support portion which faces a rear stepped portion of the ledge and through which the insulator is supported. The insulator further has, in a region which faces the ledge, a diameter reduction portion whose outside diameter reduces along the frontward direction from the support portion, and a diameter increase portion which is located frontward of the diameter reduction portion and whose outside diameter increases along the frontward direction.

According to the spark plug of application example 1, since carbon is unlikely to adhere to a region having the diameter reduction portion and the diameter increase portion, the generation of leakage current can be restrained while heat resistance is maintained.

Application Example 2

A spark plug according to application example 1, satisfying a relational expression $0.84 \leq A/B \leq 0.95$, where, when a direction perpendicular to the axial direction is taken as a radial direction, A is a thickness of a most thin-walled subportion having a smallest radial wall thickness of the diameter reduction portion, and B is a thickness of a most thick-walled subportion having a largest radial wall thickness of the diameter increase portion.

According to the spark plug of application example 2, since the value of A/B is set within an appropriate range, fouling resistance can be improved while dielectric strength is maintained.

Application Example 3

A spark plug according to application example 1 or 2, satisfying a relational expression $0.2\ \text{mm} \leq C \leq 0.5\ \text{mm}$, where, when a direction perpendicular to the axial direction is taken as a radial direction, C is a smallest distance as measured in the radial direction across a gap between the insulator and the metallic shell in a region located frontward of the most thin-walled subportion having the smallest radial wall thickness of the diameter reduction portion.

According to the spark plug of application example 3, since the distance C is set within an appropriate range, fouling resistance can be improved while heat resistance is maintained.

Application Example 4

A spark plug according to any one of application examples 1 to 3, satisfying a relational expression $0.8\ \text{mm} \leq D$, where, when a direction perpendicular to the axial direction is taken as a radial direction, D is a distance between a position on an outline of the insulator corresponding to the most thick-walled subportion having the largest radial wall thickness of the diameter increase portion and a position where an imaginary line extending rearward in parallel with the axial direction from the position corresponding to the most thick-walled subportion intersects with the outline of the insulator.

According to the spark plug of application example 4, since the distance D is set within an appropriate range, fouling resistance can be improved.

Application Example 5

A spark plug according to any one of application examples 1 to 4, satisfying a relational expression $0.1\ \text{mm}^2 \leq S \leq 0.35\ \text{mm}^2$, where, when a direction perpendicular to the axial direction is taken as a radial direction, S is an area of a region surrounded by an outline of the insulator and an imaginary line extending rearward in parallel with the axial direction from a position on the outline of the insulator corresponding to the most thick-walled subportion having the largest radial wall thickness of the diameter increase portion.

According to the spark plug of application example 5, since the area S is set to an appropriate magnitude, fouling resistance can be improved.

Other Application Examples

In such a spark plug, the diameter reduction portion may be formed such that it continuously extends from the support portion of the insulator; alternatively, the diameter reduction portion may be formed such that a parallel portion having a predetermined length and extending in parallel with the axial direction is present between the support portion and the diameter reduction portion. In the case of provision of the parallel portion, the parallel portion may be smaller in outside diameter than the most thick-walled subportion having the largest radial wall thickness of the diameter increase portion. Also, the insulator may have, between the diameter reduction portion and the diameter increase portion, a fixed-diameter portion whose outside diameter is fixed along a predetermined length. In any of these cases mentioned above, since the diameter reduction portion and the diameter increase portion exist, carbon becomes unlikely to adhere to this region, and the generation of leakage current can be restrained while heat resistance is maintained.

Furthermore, the side surface of the ledge of the metallic shell which faces the insulator is not necessarily parallel to the axial direction, but may be inclined by a predetermined angle (about 1 degree to 10 degrees) with respect to the axial direction. Also, the surface may have irregularities. Through employment of such a configuration that the ledge of the metallic shell has a flat portion which extends along a predetermined length in parallel with the axial direction and that the diameter increase portion of the insulator is provided in a region which faces the flat portion, carbon becomes further unlikely to adhere to this region, and the generation of leakage current can be restrained while heat resistance is maintained.

The present invention can be implemented in various forms. For example, the present invention can be implemented in a method of manufacturing a spark plug, an apparatus for manufacturing a spark plug, and a system of manufacturing a spark plug.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION MODES FOR CARRYING OUT THE INVENTION

Embodiments of a spark plug according to a mode for carrying out the present invention will next be described in the following order.

A. First embodiment
B. Second embodiment
C. Dielectric strength test
D. Fouling resistance test 1
E. Fouling resistance test 2
F. Fouling resistance test 3
G. Fouling resistance test 4 and heat resistance test
H. Modified embodiments

A. First Embodiment

Figure 1:
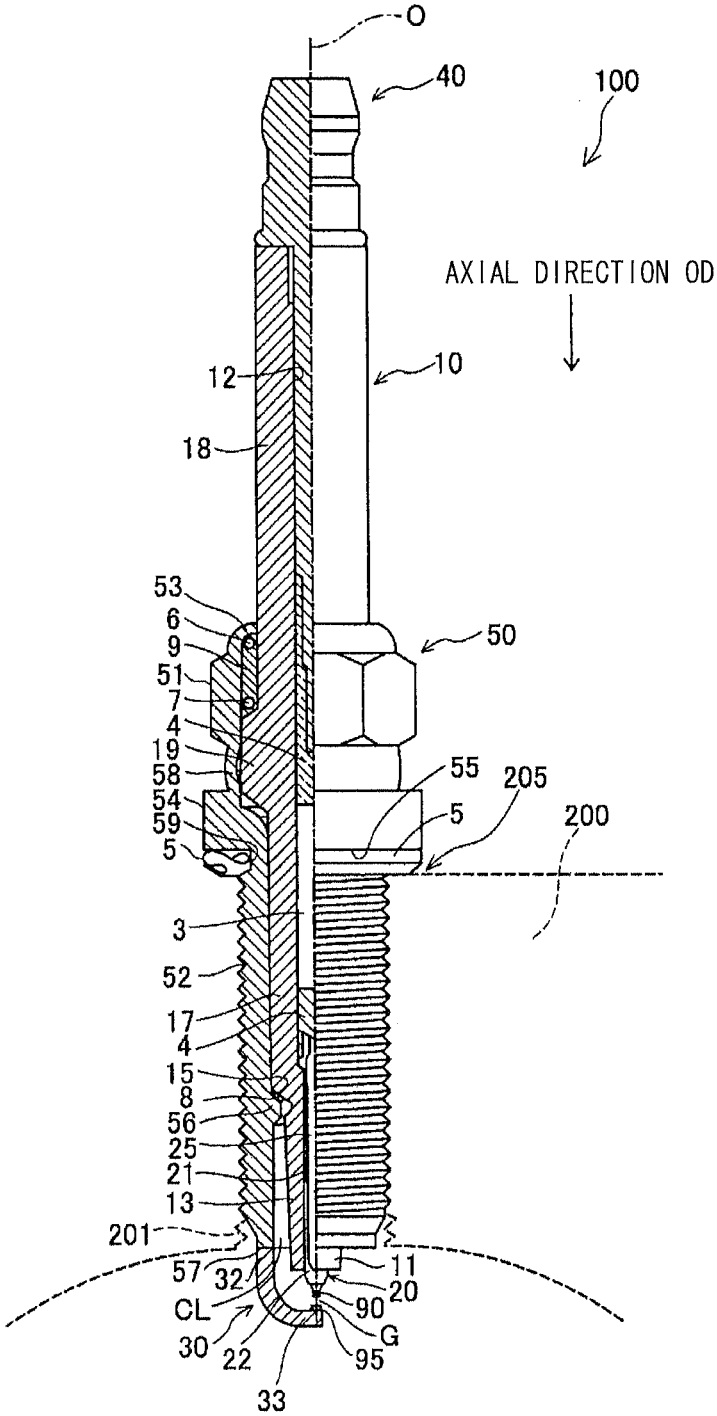
FIG. 1 is a partially sectional view showing a spark plug 100 according to an embodiment of the present invention.

FIG. 1 is a partially sectional view showing a spark plug 100 according to an embodiment of the present invention. In the following description, an axial direction OD of the spark plug 100 in FIG. 1 is referred to as the vertical direction, and the lower side of the spark plug 100 in FIG. 1 is referred to as the front side of the spark plug 100, and the upper side as the rear side.

The spark plug 100 includes a ceramic insulator 10, a metallic shell 50, a center electrode 20, a ground electrode 30, and a metal terminal 40. The center electrode 20 is held in the ceramic insulator 10 while extending in the axial direction OD. The ceramic insulator 10 functions as an insulator. The metallic shell 50 holds the ceramic insulator 10. The metal terminal 40 is provided at a rear end portion of the ceramic insulator 10.

The ceramic insulator 10 is formed from alumina or the like through firing and has a tubular shape such that an axial bore 12 extends therethrough coaxially along the axial direction OD. The ceramic insulator 10 has a flange portion 19 having the largest outside diameter and located substantially at the center with respect to the axial direction OD and a rear trunk portion 18 located rearward (upward in FIG. 1) of the flange portion 19. The ceramic insulator 10 also has a front trunk portion 17 smaller in outside diameter than the rear trunk portion 18 and located frontward (downward in FIG. 1) of the flange portion 19, and a leg portion 13 smaller in outside diameter than the front trunk portion 17 and located frontward of the front trunk portion 17. The leg portion 13 is reduced in diameter in the frontward direction and is exposed to a combustion chamber of an internal combustion engine when the spark plug 100 is mounted to an engine head 200 of the engine. The ceramic insulator 10 further has a support portion 15 formed between the leg portion 13 and the front trunk portion 17.

The metallic shell 50 is a cylindrical metallic member formed of low-carbon steel and is adapted to fix the spark plug 100 to the engine head 200 of the internal combustion engine. The metallic shell 50 holds the ceramic insulator 10 therein while surrounding a region of the ceramic insulator 10 extending from a portion of the rear trunk portion 18 to the leg portion 13.

The metallic shell 50 has a tool engagement portion 51 and a mounting threaded portion 52. The tool engagement portion 51 allows a spark plug wrench (not shown) to be fitted thereto. The mounting threaded portion 52 of the metallic shell 50 has threads formed thereon and is threadingly engaged with a mounting threaded hole 201 of the engine head 200 provided at an upper portion of the internal combustion engine.

The metallic shell 50 has a flange-like seal portion 54 formed between the tool engagement portion 51 and the mounting threaded portion 52. An annular gasket 5 formed by folding a sheet is fitted to a screw neck 59 between the mounting threaded portion 52 and the seal portion 54. When the spark plug 100 is mounted to the engine head 200, the gasket 5 is crushed and deformed between a seat surface 55 of the seal portion 54 and a mounting surface 205 around the opening of the mounting threaded hole 201. The deformation of the gasket 5 provides a seal between the spark plug 100 and the engine head 200, thereby preventing gas leakage form inside the engine via the mounting threaded hole 201.

The metallic shell 50 has a thin-walled crimp portion 53 located rearward of the tool engagement portion 51. The metallic shell 50 also has a buckle portion 58, which is thin-walled similar to the crimp portion 53, between the seal portion 54 and the tool engagement portion 51. Annular ring members 6 and 7 intervene between an outer circumferential surface of the rear trunk portion 18 of the ceramic insulator 10 and an inner circumferential surface of the metallic shell 50 extending from the tool engagement portion 51 to the crimp portion 53. Further, a space between the two ring members 6 and 7 is filled with a powder of talc 9. When the crimp portion 53 is crimped inward, the ceramic insulator 10 is pressed frontward within the metallic shell 50 via the ring members 6 and 7 and the talc 9. Accordingly, the support portion 15 of the ceramic insulator 10 is supported by a ledge 56 formed on the inner circumference of the metallic shell 50, whereby the metallic shell 50 and the ceramic insulator 10 are united together. At this time, gastightness between the metallic shell 50 and the ceramic insulator 10 is maintained by means of an annular sheet packing 8 which intervenes between the support portion 15 of the ceramic insulator 10 and the ledge 56 of the metallic shell 50, thereby preventing outflow of combustion gas. The buckle portion 58 is designed to be deformed outwardly in association with application of compressive force in a crimping process, thereby contributing toward increasing the stroke of compression of the talc 9 and thus enhancing gastightness within the metallic shell 50. A clearance CL having a predetermined dimension is provided between the ceramic insulator 10 and a portion of the metallic shell 50 located frontward of the ledge 56. The shape of the ledge 56 will be described in detail later with reference to FIG. 2.

The center electrode 20 is a rodlike electrode having a structure in which a core 25 is embedded within an electrode base metal 21. The electrode base metal 21 is formed of nickel or an alloy which contains Ni as a main component, such as INCONEL™ 600 or 601. The core 25 is formed of copper or an alloy which contains Cu as a main component, copper and the alloy being superior in thermal conductivity to the electrode base metal 21. Usually, the center electrode 20 is fabricated as follows: the core 25 is disposed within the electrode base metal 21 which is formed into a closed-bottomed tubular shape, and the resultant assembly is drawn by extrusion from the bottom side. The core 25 is formed such that, while a trunk portion has a substantially fixed outside diameter, a front end portion is tapered. The center electrode 20 extends rearward through the axial bore 12 and is electrically connected to the metal terminal 40 via a seal body 4 and a ceramic resistor 3. A high-voltage cable (not shown) is connected to the metal terminal 40 via a plug cap (not shown) for applying high voltage to the metal terminal 40.

A front end portion 22 of the center electrode 20 projects from a front end portion 11 of the ceramic insulator 10. A center electrode tip 90 is joined to the front end surface of the front end portion 22 of the center electrode 20. The center electrode tip 90 has a substantially circular columnar shape extending in the axial direction OD and is formed of a noble metal having high melting point in order to improve resistance to spark-induced erosion. The center electrode tip 90 is formed of, for example, iridium (Ir) or an Ir alloy which contains Ir as a main component and an additive of one or more elements selected from among platinum (Pt), rhodium (Rh), ruthenium (Ru), palladium (Pd), and rhenium (Re).

The ground electrode 30 is formed of a metal having high corrosion resistance; for example, a nickel alloy, such as INCONEL™ 600 or 601. A proximal end portion 32 of the ground electrode 30 is joined to a front end portion 57 of the metallic shell 50 by welding. Also, the ground electrode 30 is bent such that a distal end portion 33 thereof faces the center electrode tip 90.

Furthermore, a ground electrode tip 95 is joined to the distal end portion 33 of the ground electrode 30. The ground electrode tip 95 faces the center electrode tip 90, thereby forming a spark discharge gap G therebetween. The ground electrode tip 95 can be formed from a material similar to that used to form the center electrode tip 90.

Figure 2:
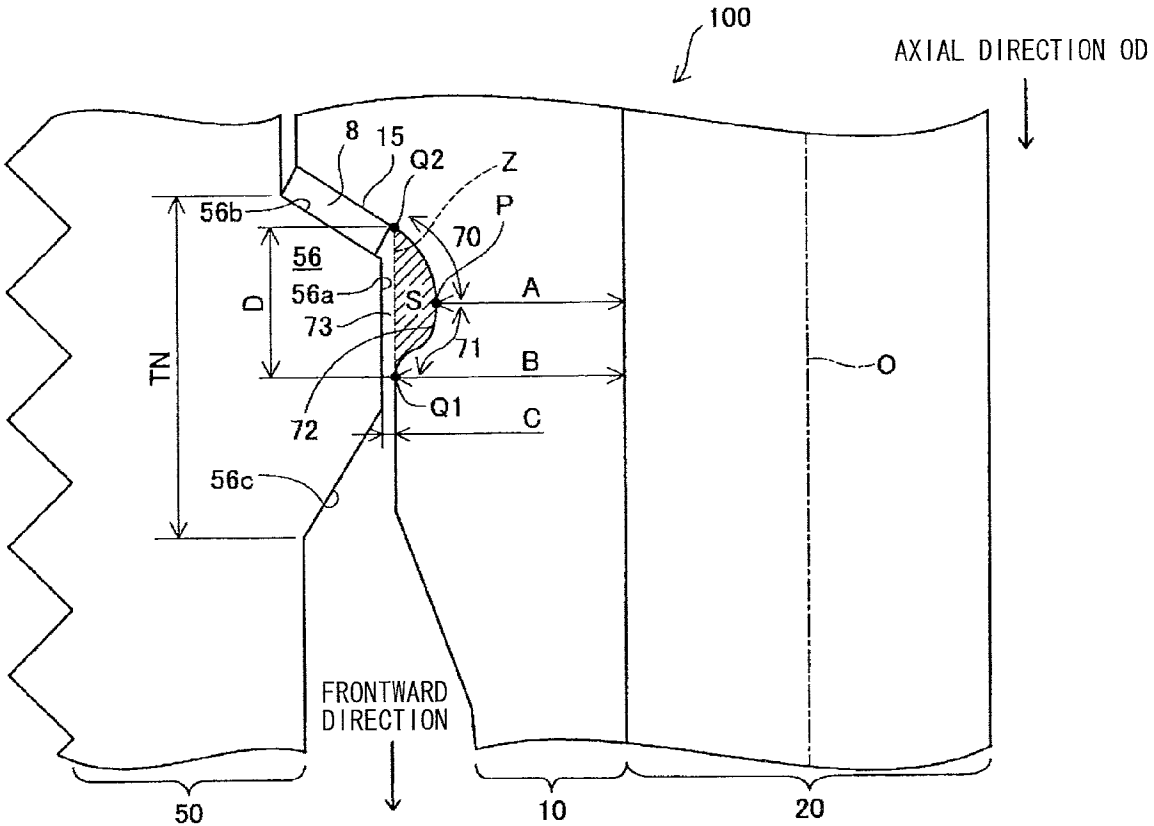
FIG. 2 is a explanatory view showing, on an enlarged scale, a support portion 15 of a ceramic insulator 10 and its vicinity.

FIG. 2 is an explanatory view showing, on an enlarged scale, the support portion 15 of the ceramic insulator 10 and its vicinity. A direction which is parallel to the axial direction OD and is directed from the support portion 15 toward a spark portion (the spark discharge gap G) formed between the center electrode 20 and the ground electrode 30 is called a "frontward direction," and an opposite direction is called a "rearward direction." Also, a direction orthogonal to the axial direction OD is called a "radial direction." The ceramic insulator 10 has a diameter reduction portion 70 whose outside diameter reduces along the frontward direction from the support portion 15. Furthermore, the ceramic insulator 10 has a diameter increase portion 71 whose outside diameter increases along the frontward direction from the front end of the diameter reduction portion 70. Accordingly, a depression 72 is formed frontward of the support portion 15. The above-mentioned ledge 56 of the metallic shell 50 faces the depression 72 of the ceramic insulator 10. The ledge 56 includes a flat portion **56*a* which faces the depression 72 of the ceramic insulator 10; a rear stepped portion 56*b* located rearward of the flat portion 56*a*; and a front stepped portion 56*c* located frontward of the flat portion 56*a*. The rear stepped portion 56*b* of the ledge 56 has the same inclination as that of the support portion 15 of the ceramic insulator 10 and nips the sheet packing 8 in cooperation with the support portion 15. The front stepped portion 56*c* is located frontward of the flat portion 56*a* and gradually increases in inside diameter. The ledge 56 is a portion extending over a range TN shown in FIG. 2. The above-mentioned diameter reduction portion 70 and diameter increase portion 71 of the ceramic insulator 10 are provided at a position corresponding to the ledge 56. The depression 72 substantially faces the flat portion 56*a* of the ledge 56. Thus, a gap 73 between the metallic shell 50 and the ceramic insulator 10 is large at a location where the depression 72 exists, and is narrowed again at a location located frontward of the depression 72**.

In this manner, by means of the ceramic insulator 10 having the depression 72 and the gap 73 being narrowed at a location located frontward of the depression 72, at the time of incomplete combustion of the air-fuel mixture, entry of carbon into the gap 73 can be restrained, and adhesion of carbon to the depression 72 can be restrained. Furthermore, since combustion gas is unlikely to reach the depression 72 of the ceramic insulator 10, the temperature rise of the ceramic insulator 10 can be restrained; accordingly, heat resistance of the spark plug can be improved.

Furthermore, the gap 73 is greater than that of the case where an outline located frontward of the support portion 15 is straight (broken line Z) along the axial direction OD. Thus, even when carbon enters the gap 73, there can be restrained a problem in that the gap 73 is clogged with accumulated carbon with the resultant generation of leakage current between the metallic shell 50 and the ceramic insulator 10.

Meanwhile, A represents the thickness of a most thin-walled subportion P having the smallest radial wall thickness of the diameter reduction portion 70. Also, B represents the thickness of a most thick-walled subportion Q1 having the largest radial wall thickness of the diameter increase portion 71. In this case, preferably, the spark plug 100 satisfies the following relational expression (1).

$$0.84 \leq A/B \leq 0.95 \quad (1)$$

The reason for this is as follows. In the following description, A/B may also be called "ceramic-insulator wall-thickness ratio A/B."

When the depression 72 of the ceramic insulator 10 is excessively small; in other words, the ceramic-insulator wall-thickness ratio A/B is excessively large, carbon accumulates in the depression 72, resulting in an increase in the possibility of electrical communication between the metallic shell 50 and the center electrode 20. That is, the effect of improving fouling resistance is weakened. When the depression 72 of the ceramic insulator 10 is excessively large; in other words, the ceramic-insulator wall-thickness ratio A/B is excessively small, fouling resistance improves, but dielectric breakdown is apt to occur at the most thin-walled subportion P, resulting in a deterioration in dielectric strength.

By means of the spark plug 100 being configured such that the ceramic insulator 10 satisfies the relational expression (1), fouling resistance can be improved while dielectric strength is maintained. Grounds for specification of the numerical range of the ceramic-insulator wall-thickness ratio A/B as expressed by the relational expression (1) will be described later.

Also, C represents the smallest distance as measured in the radial direction across the gap 73 between the ceramic insulator 10 and the metallic shell 50 in a region located frontward of the most thin-walled subportion P having the smallest radial wall thickness of the diameter reduction portion 70. In this case, preferably, the spark plug 100 satisfies the following relational expression (2).

$$0.2\ \text{mm} \leq C \leq 0.5\ \text{mm} \quad (2)$$

The reason for this is as follows. When the distance C is excessively large, carbon and combustion gas are apt to enter the depression 72 of the ceramic insulator 10, resulting in a deterioration in fouling resistance and heat resistance. When the distance C is excessively small, carbon accumulates in the gap of the distance C and clogs the gap, potentially resulting in a further deterioration in fouling resistance. By means of the spark plug 100 being configured such that the ceramic insulator 10 satisfies the relational expression (2), fouling resistance can be improved appropriately while heat resistance is maintained. Grounds for specification of the numerical range of the distance C as expressed by the relational expression (2) will be described later.

Also, when D represents the distance between a point on the outline of the ceramic insulator 10 corresponding to the most thick-walled subportion Q1 having the largest radial wall thickness of the diameter increase portion 71 and a point Q2 where an imaginary line (in FIG. 2, the broken line extending rearward in parallel with the axial direction OD from the position corresponding to the most thick-walled subportion Q1 intersects with the outline of the ceramic insulator 10, preferably, the spark plug 100 satisfies the following relational expression (3).

$$0.8\ \text{mm} \leq D \quad (3)$$

The reason for this is as follows. When the length of the depression 72 of the ceramic insulator 10 along the axial direction OD is excessively short, a range where the gap 73 is sufficiently secured reduces, resulting in a deterioration in the effect of improving fouling resistance. By means of the spark plug 100 being configured such that the ceramic insulator 10 satisfies the relational expression (3), fouling resistance can be improved appropriately. Grounds for specification of the numerical range of the distance D as expressed by the relational expression (3) will be described later.

Furthermore, the magnitude of the depression 72 is specified as follows. When S represents the area of a region (the hatched region in FIG. 2) surrounded by the outline of the ceramic insulator 10 and the imaginary line (broken line Z) shown in FIG. 2, preferably, the spark plug 100 satisfies the following expression (4).

$$0.1\ \text{mm}^2 \leq S \leq 0.35\ \text{mm}^2 \quad (4)$$

The reason for this is as follows. When the sectional area S of the depression 72 of the insulator 10 is excessively small, the effect of improving fouling resistance deteriorates. When the sectional area S is excessively large, heat resistance deteriorates. By means of the spark plug 100 being configured such that the ceramic insulator 10 satisfies the relational expression (4), while fouling resistance is improved appropriately, heat resistance can be secured. Grounds for specification of the numerical range of the area S as expressed by the relational expression (4) will be described later.

The spark plug 100 does not necessarily meet all of the conditions mentioned above, but may meet any one or more of the conditions mentioned above. However, by means of the spark plug 100 being configured so as to meet all of the conditions mentioned above, fouling resistance can be improved more appropriately.

B. Second Embodiment

Figure 3:
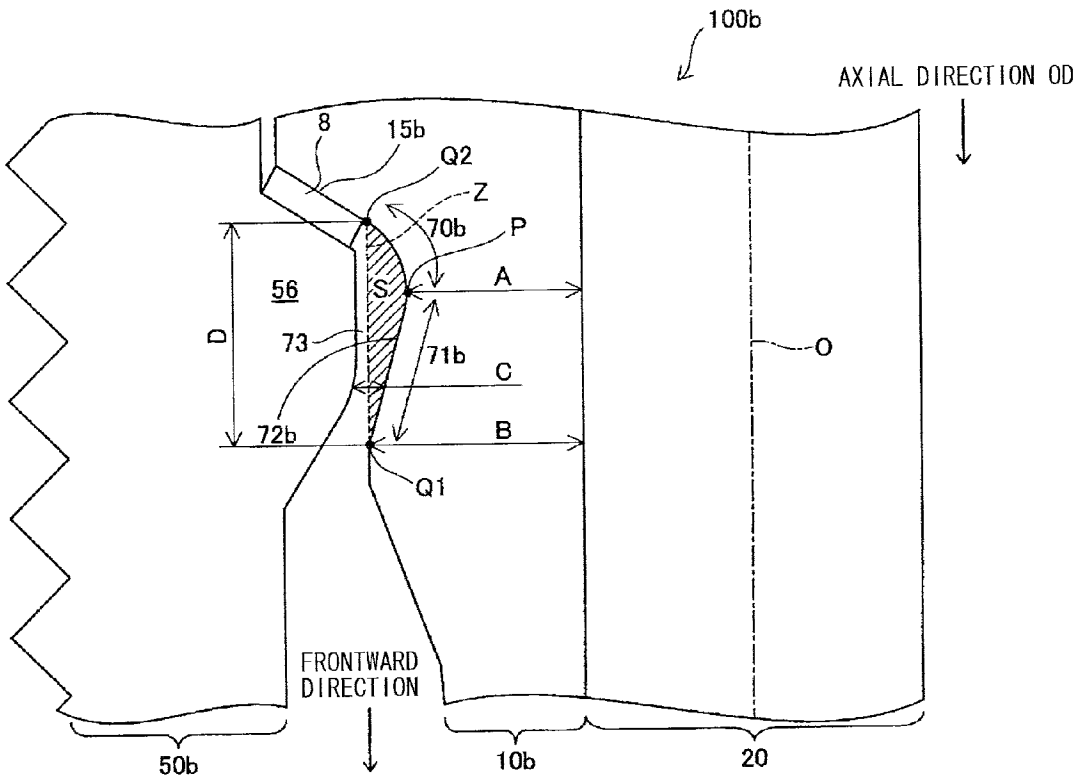
FIG. 3 is an enlarged view showing a support portion 15*b* of a ceramic insulator 10*b* of a spark plug 100*b* according to a second embodiment of the present invention.

FIG. 3 is an enlarged view showing a support portion 15*b* of a ceramic insulator 10*b* of a spark plug 100*b* according to a second embodiment of the present invention. The second embodiment differs from the first embodiment shown in FIG. 2 only in the shape of a metallic shell 50*b* and the shape of the ceramic insulator 10*b*. Other configurational features are similar to those of the first embodiment. In the ceramic insulator 10*b*, a diameter increase portion 71*b* has such a shape as to extend along the axial direction OD. Thus, the distance D in the second embodiment is longer than the distance D in the first embodiment. Also, a location where the gap 73 is the smallest (a location associated with the distance C) is located rearward of the most thick-walled subportion Q1. Even though the ceramic insulator 10*b* has such a shape, similar to the first embodiment, fouling resistance can be improved while heat resistance is improved; thus, the generation of leakage current can be restrained.

C. Dielectric Strength Test

In order to study the relation between the ceramic-insulator wall-thickness ratio A/B and the dielectric strength, a dielectric strength test was conducted by use of a plurality of spark plugs which differed in the ceramic-insulator wall-thickness ratio A/B. In the dielectric strength test, while a sample spark plug was immersed in insulation oil, a voltage of a spark discharge waveform was applied between the metallic shell 50 and the metal terminal 40. In this case, since insulation oil exists in the spark discharge gap G, a spark discharge is not generated across the spark discharge gap G. In the course of repeating application of the spark discharge waveform voltage while the maximum value of the spark discharge waveform voltage was gradually increased, dielectric breakdown occurred in the ceramic insulator 10. The maximum value of the spark discharge waveform voltage at this time was recorded as dielectric strength. A spark plug whose ceramic insulator 10 did not have the depression 72 was also measured for dielectric strength. The rate of decrease from this dielectric strength was recorded as a dielectric-strength decrease rate (%).

Figure 4:
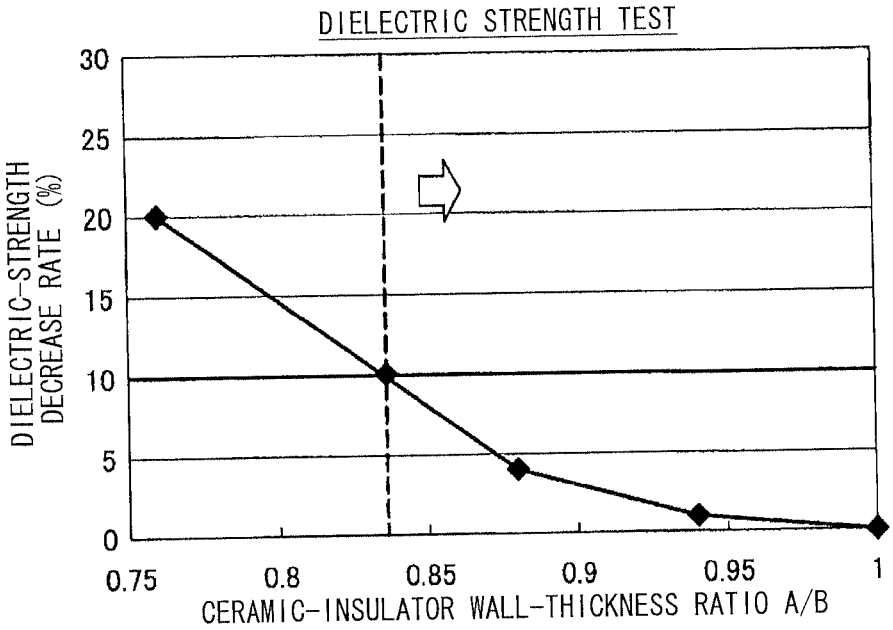
FIG. 4 is a graph showing the relation between the ceramic-insulator wall-thickness ratio A/B and the dielectric-strength decrease rate (%).

FIG. 4 is a graph showing the relation between the ceramic-insulator wall-thickness ratio A/B and the dielectric-strength decrease rate (%). In FIG. 4, the horizontal axis shows the ceramic-insulator wall-thickness ratio A/B, and the vertical axis shows the dielectric-strength decrease rate (%). According to FIG. 4, as the ceramic-insulator wall-thickness ratio A/B increases, the dielectric-strength decrease rate reduces. Furthermore, by means of the ceramic-insulator wall-thickness ratio A/B assuming 0.84 or greater, the dielectric-strength decrease rate can be 10% or less. Thus, it is understandable that a ceramic-insulator wall-thickness ratio A/B of 0.84 or greater is preferred. Also, it is understandable from FIG. 4 that a ceramic-insulator wall-thickness ratio A/B of 0.88 or greater is further preferred.

D. Fouling Resistance Test 1

In order to study the relation between the ceramic-insulator wall-thickness ratio A/B and the fouling resistance, a fouling resistance test 1 was conducted by use of a plurality of spark plugs which differed in the ceramic-insulator wall-thickness ratio A/B. In the fouling resistance test 1, the spark plugs were evaluated by use of the number of cycles reaching 10 MΩ. "The number of cycles reaching 10 MΩ" is the number of test cycles required until the insulation resistance of a spark plug for an internal combustion engine decreases to 10 MΩ when the spark plug is subjected to a carbon fouling test specified in the adaptability test code of spark plug for automobiles (JIS D1606). Thus, the greater the number of cycles reaching 10 MΩ, the slower the decrease of insulation resistance. In other words, the greater the number of cycles reaching 10 MΩ, the less likely the accumulation of electrically conductive fouling substances, such as carbon and metal oxides (the higher the fouling resistance).

Figure 5:
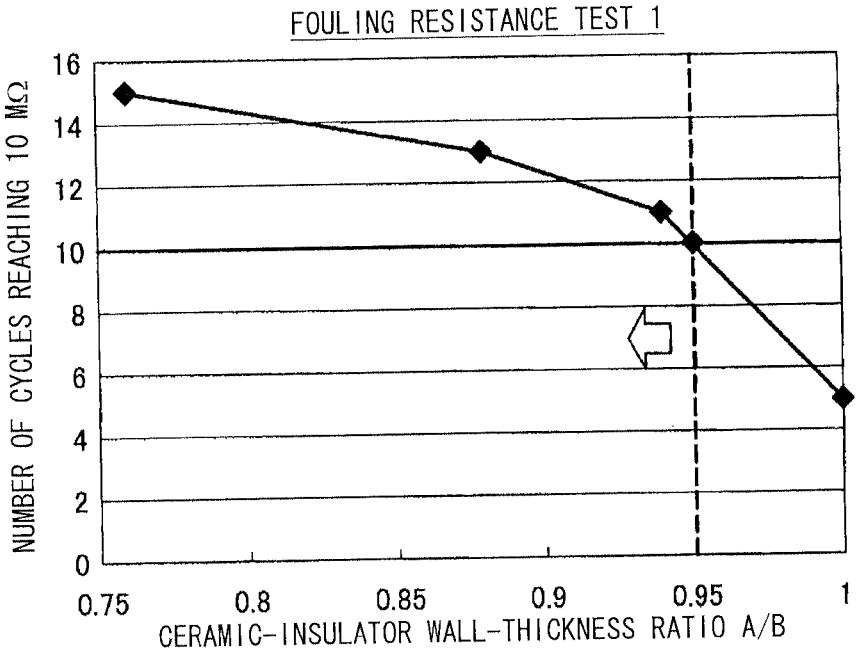
FIG. 5 is a graph showing the relation between the ceramic-insulator wall-thickness ratio A/B and the number of cycles reaching 10 MΩ.

FIG. 5 is a graph showing the relation between the ceramic-insulator wall-thickness ratio A/B and the number of cycles reaching 10 MΩ. According to FIG. 5, as the ceramic-insulator wall-thickness ratio A/B increases, the number of cycles reaching 10 MΩ decreases. That is, as the ceramic-insulator wall-thickness ratio A/B increases, fouling resistance deteriorates. By means of the ceramic-insulator wall-thickness ratio A/B assuming 0.95 or less, the number of cycles reaching 10 MΩ can be 10 or greater. Thus, it is understandable that a ceramic-insulator wall-thickness ratio A/B of 0.95 or less is preferred. Also, it is understandable from FIG. 5 that the ceramic-insulator wall-thickness ratio A/B is more preferably 0.94 or less, most preferably 0.88 or less.

In view of the results of the fouling resistance test 1 and the results of the aforementioned dielectric strength test, it is understandable that, as expressed by the aforementioned relational expression (1), a ceramic-insulator wall-thickness ratio A/B of 0.84 to 0.95 inclusive is preferred.

E. Fouling Resistance Test 2

In order to study the relation between the above-mentioned distance C (mm) and fouling resistance, a fouling resistance test 2 was conducted by use of a plurality of spark plugs which differed in the distance C. Similar to the fouling resistance test 1, the fouling resistance test 2 also used the number of cycles reaching 10 MΩ to evaluate the spark plugs.

Figure 6:
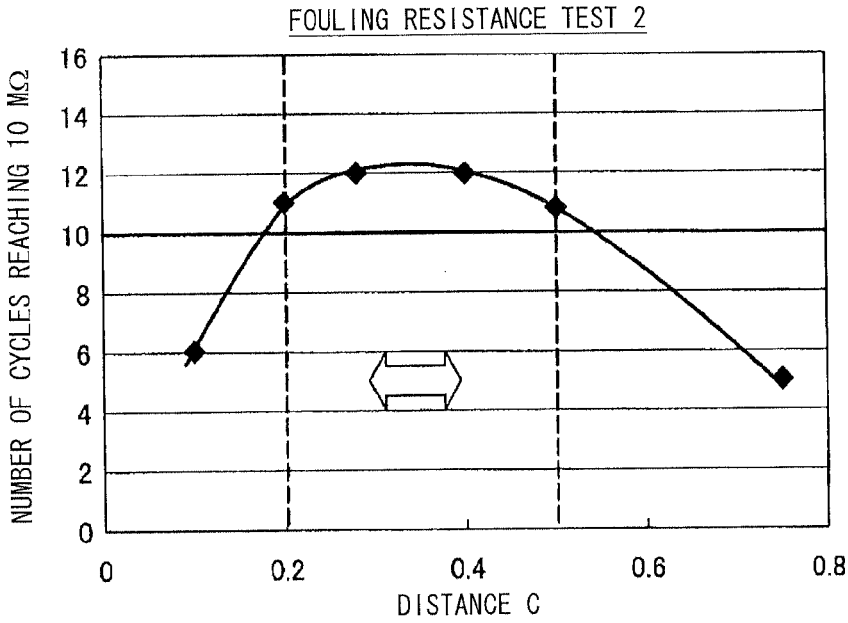
FIG. 6 is a graph showing the relation between the distance C and the number of cycles reaching 10 MΩ.

FIG. 6 is a graph showing the relation between the distance C and the number of cycles reaching 10 MΩ. In this test, the spark plugs have a ceramic-insulator wall-thickness ratio A/B of 0.85. According to FIG. 6, until the distance C reaches near 0.3 mm, the number of cycles reaching 10 MS/increases with the distance C. However, after the distance C exceeds around 0.4 mm, as the distance C increases, the number of cycles reaching 10 MΩ decreases. By means of the distance C falling within a range of 0.2 mm to 0.5 mm inclusive, the number of cycles reaching 10 MΩ can be 10 or greater. Thus, it is understandable that, as expressed by the aforementioned relational expression (2), a distance C of 0.2 mm to 0.5 mm inclusive is preferred. Also, it is understandable from FIG. 6 that the distance C is more preferably 0.2 mm to 0.4 mm inclusive, most preferably 0.3 mm to 0.4 mm inclusive.

F. Fouling Resistance Test 3

In order to study the relation between the above-mentioned distance D (mm) and fouling resistance, a fouling resistance test 3 was conducted by use of a plurality of spark plugs which differed in the distance D. Similar to the fouling resistance test 1, the fouling resistance test 3 also used the number of cycles reaching 10 MΩ to evaluate the spark plugs.

Figure 7:
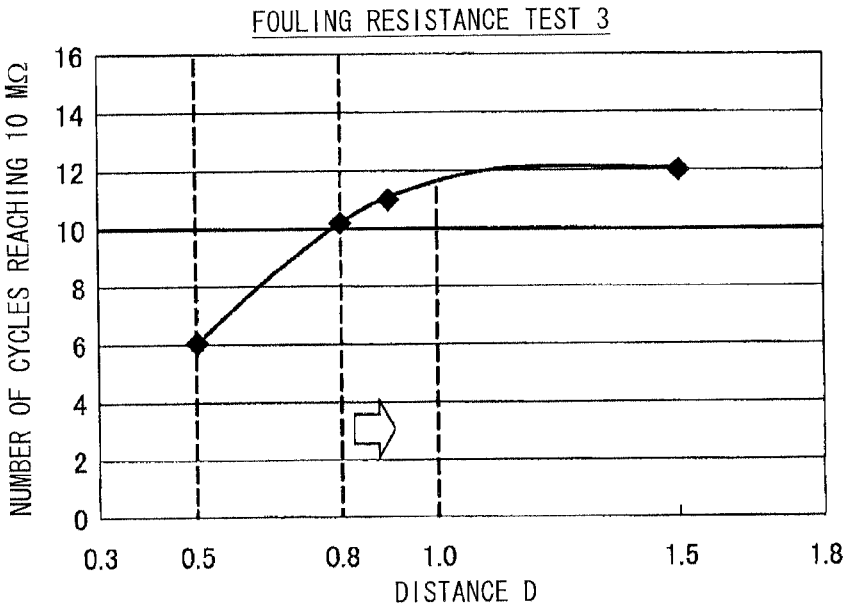
FIG. 7 is a graph showing the relation between the distance D and the number of cycles reaching 10 MΩ.

FIG. 7 is a graph showing the relation between the distance D and the number of cycles reaching 10 MΩ. In this test, the spark plugs have a ceramic-insulator wall-thickness ratio A/B of 0.85 and a distance C of 0.4 mm. According to the FIG. 7, the number of cycles reaching 10 MΩ increases with the distance D. That is, as the distance D increases, fouling resistance improves. By means of the distance D assuming 0.8 mm or greater, the number of cycles reaching 10 MΩ can be 10 or greater. Thus, it is understandable that, as expressed by the aforementioned relational expression (3), a distance D of 0.8 mm or greater is preferred. Also, it is understandable from FIG. 7 that the distance D is more preferably 0.9 mm or greater.

G. Fouling Resistance Test and Heat Resistance Test

In order to study the relation between the above-mentioned sectional area S ($mm^2$) and fouling resistance and the relation between the sectional area S and heat resistance, a fouling test and a heat resistance test were conducted by use of a plurality of spark plugs which differed in the sectional area S. Similar to the fouling resistance test 1, the fouling resistance test also used the number of cycles reaching 10 MΩ to evaluate the spark plugs.

Figure 8:
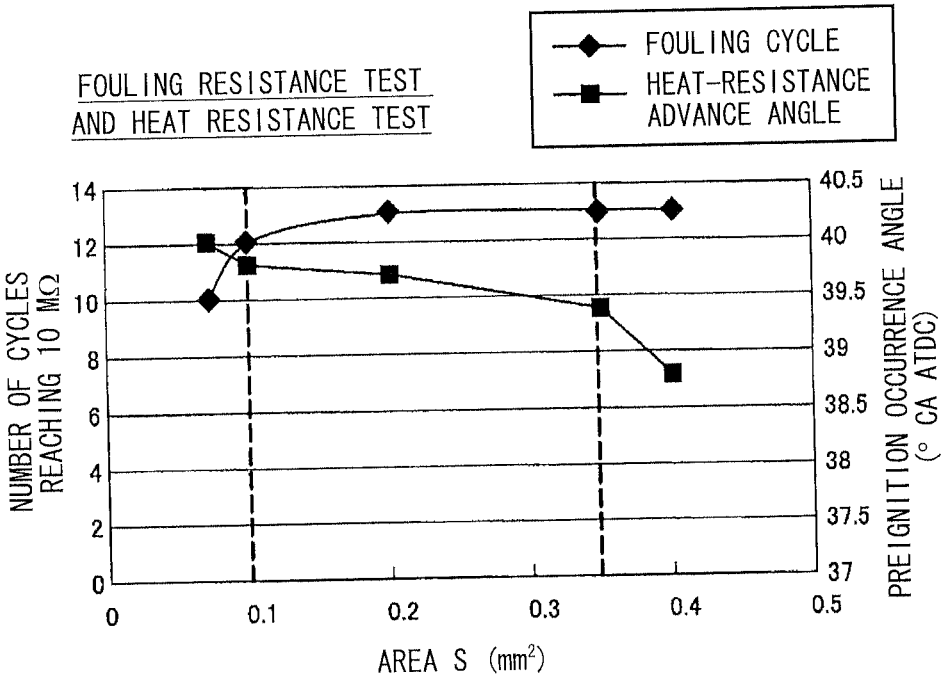
FIG. 8 is a graph showing the relation between the area S and the number of cycles reaching 10 MΩ and the relation between the area S and the preignition occurrence angle.

FIG. 8 is a graph showing the relation between the sectional area S and the number of cycles reaching 10 MΩ and the relation between the sectional area S and heat resistance. In this test, the spark plugs have a ceramic-insulator wall-thickness ratio A/B of 0.85, a distance C of 0.4 mm, and a distance D of 2 mm. According to the FIG. 8, the number of cycles reaching 10 MΩ increases with the area S. That is, as the area S increases, fouling resistance improves. By means of the area S assuming 0.1 $mm^2$ or greater, the number of cycles reaching 10 MΩ can be 12 or greater.

Meanwhile, it has been revealed that the area S influences heat resistance; specifically, when the area S is excessively large, heat resistance deteriorates. A preferred range of the area S from the viewpoint of heat resistance of a spark plug is described. The heat resistance test was conducted through operation of an engine under the following conditions.

Engine: displacement 1.6 L, 4 cycles, DOHC engine

Fuel: unleaded high-octane gasoline

Room temperature/humidity: 20° C./60%

Oil temperature: 80° C.

Test pattern: engine speed 5,500 rpm, full throttle opening (2 minutes)

Spark plugs which differed in the area S were mounted to the engine. The engine was operated under the above conditions. While ignition timing was gradually advanced, an ignition timing when preignition occurred was measured as an advance angle from TDC. In FIG. 8, the right vertical axis indicates an angle (unit: degree) at which preignition occurred. By means of measuring an advance angle at which preignition occurred; i.e., a preignition occurrence advance angle, the heat resistance of the spark plug can be evaluated. The greater the preignition occurrence advance angle, the higher the heat conductivity (heat resistance) of the spark plug. This is for the following reason.

Generally, when ignition timing is further advanced, the time of exposure to a new air-fuel mixture becomes relatively short, whereas the time of exposure to combustion gas becomes relatively long; thus, the temperature of a front end of a spark plug is apt to rise. When the front-end temperature of the spark plug rises excessively, preignition, or ignition through compression of an air-fuel mixture, may occur. In other words, since a spark plug free from preignition even at a large advance angle exhibits good heat transfer, the preignition occurrence advance angle becomes large. Thus, by means of measurement of the preignition occurrence advance angle, the heat resistance (heat conductivity) of the spark plug can be evaluated.

As is apparent from FIG. 8, as the area S increases in excess of 0.35 $mm^2$, the preignition occurrence advance angle reduces sharply, indicating a deterioration in heat resistance of the spark plug. Thus, it is understandable from the heat resistance test that an area S of 0.35 $mm^2$ or less is desirable. From the results of the two tests (i.e., the fouling resistance test and the heat resistance test) shown in FIG. 8, it is understandable that, preferably, the area S falls within the range shown by the above-mentioned relational expression (4).

H. Modified Embodiments

The present invention is not limited to the above-described embodiments or modes, but may be embodied in various other forms without departing from the gist of the invention. For example, the following modifications are possible.

H1. Modified Embodiment 1

Figure 9:
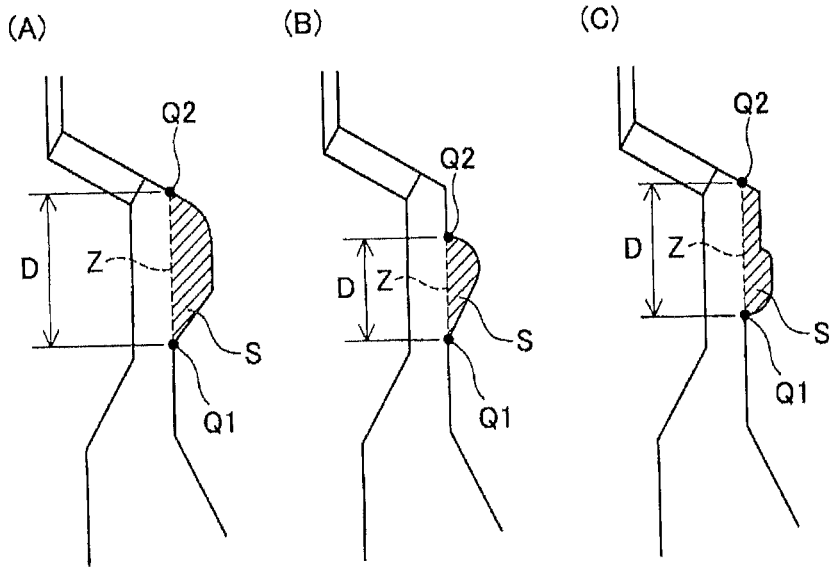
FIGS. 9(A) to 9(C) are explanatory views showing other embodiments of the present invention.

In the above-described embodiment, the diameter reduction portion 70 and the diameter increase portion 71 are formed continuous to each other. However, for example, as shown in FIG. 9(A), a fixed-diameter portion whose outside diameter is fixed may be formed between the diameter reduction portion and the diameter increase portion. Also, in the above-described embodiment, the diameter reduction portion and the diameter increase portion assume curved shapes. However, as shown in FIGS. 9(A) and 9(B), at least one of the diameter reduction portion and the diameter increase portion may assume a shape whose diameter varies rectilinearly. Also, as shown in FIG. 9(C), the diameter reduction portion may be configured such that its diameter reduces in two steps. In FIG. 9(C), the diameter varies in two steps with respect to the diameter reduction portion; however, the diameter may vary similarly with respect to the diameter increase portion. Of course, the diameter may increase or reduce in three or more steps. Also, the boundary between the diameter reduction portion and the diameter increase portion, the boundary between the diameter reduction portion and the fixed-diameter portion, and the boundary between the fixed-diameter portion and the diameter increase portion may be angular instead of being smoothed.

In the depression 72 shown in FIG. 9(A) or 9(C), the distance D appearing in the aforementioned expression (3) is the distance between a position (Q1) on the outline of the ceramic insulator 10 corresponding to the most thick-walled subportion having the largest radial wall thickness of the diameter increase portion and a position (Q2) where the imaginary line Z extending rearward in parallel with the axial direction OD from the position (Q1) intersects with the outline of the ceramic insulator 10. Thus, in the case where, as shown in FIG. 9(B), a portion of the ceramic insulator 10 in parallel with the axial direction OD exists between the support portion 15 and the depression 72 of the ceramic insulator 10, the distance D is a distance equal to the width of the depression 72 rather than the distance between the position corresponding to the most thick-walled subportion (Q2) having the largest radial wall thickness and a position where the imaginary line extending from the position corresponding to the most thick-walled subportion intersects with the support portion 15. Also, the area S appearing in the aforementioned expression (4) is the sectional area of a depression extending along this distance D.

H2. Modified Embodiment 2

In the above-described embodiment, the direction of discharge across the spark discharge gap G is parallel to the axial direction OD. However, the ground electrode 30 and the ground electrode tip 95 may be configured such that the direction of discharge across the spark discharge gap G is perpendicular to the axial direction OD.

H3. Modified Embodiment 3

In the above-described embodiment, the center electrode tip 90 and the ground electrode tip 95 are provided on the front end of the center electrode 20 and on a distal end portion of the ground electrode 30, respectively. However, these tips may be eliminated.

DESCRIPTION OF REFERENCE NUMERALS

3: ceramic resistor
4: seal body
5: gasket
6: ring member
8: sheet packing

9: talc
10: ceramic insulator
10*b*: ceramic insulator
11: front end portion
12: axial bore
13: leg portion
15: support portion
15*b*: support portion
17: front trunk portion
18: rear trunk portion
19: flange portion
20: center electrode
21: electrode base metal
22: front end portion
25: core
30: ground electrode
32: proximal end portion
33: distal end portion
40: metal terminal
50: metallic shell
50*b*: metallic shell
51: tool engagement portion
52: mounting threaded portion
53: crimp portion
54: seal portion
55: seat surface
56: ledge
57: front end portion
58: buckle portion
59: screw neck
70: diameter reduction portion
70*b*: diameter reduction portion
71: diameter increase portion
71*b*: diameter increase portion
72: depression
73: gap
90: center electrode tip
95: ground electrode tip
100: spark plug
100*b*: spark plug
200: engine head
201: mounting threaded hole
205: mounting surface around opening

The invention claimed is:

1. A spark plug comprising:

a center electrode extending in an axial direction;

an insulator disposed externally of an outer circumference of the center electrode;

a metallic shell disposed externally of an outer circumference of the insulator and having a ledge projecting with a predetermined width toward the insulator; and a ground electrode joined to the metallic shell;

wherein, when a frontward direction is defined as a direction parallel to the axial direction toward a spark portion formed between the center electrode and the ground electrode, and a direction opposite to the frontward direction is defined as a rearward direction, the insulator has a support portion which faces a rear stepped portion of the ledge and through which the insulator is supported, and the insulator further has, in a region which faces the ledge:

a diameter reduction portion whose outside diameter reduces along the frontward direction from the support portion, and a diameter increase portion which is located frontward of the diameter reduction portion and whose outside diameter increases along the frontward direction, wherein the spark plug satisfies a relational expression $$0.84 \leq A/B \leq 0.95,$$

where, when a direction perpendicular to the axial direction is taken as a radial direction, A is a thickness of a most thin-walled subportion having a smallest radial wall thickness of the diameter reduction portion, and B is a thickness of a most thick-walled subportion having a largest radial wall thickness of the diameter increase portion.

2. The spark plug according to claim 1, satisfying a relational expression $$0.2 \leq C \leq 0.5 \text{ mm},$$

where, when a direction perpendicular to the axial direction is taken as a radial direction, C is a smallest distance as measured in the radial direction across a gap between the insulator and the metallic shell in a region located forward of the most thin-walled subportion having the smallest radial wall thickness of the diameter reduction portion.

3. The spark plug according to claim 1 or 2, satisfying a relational expression $$0.8 \text{ mm} \leq D,$$

where, when a direction perpendicular to the axial direction is taken as a radial direction, D is a distance between a position on an outline of the insulator corresponding to the most thick-walled subportion having the largest radial wall thickness of the diameter increase portion and a position where an imaginary line extending rearward in parallel with the axial direction from the position corresponding to the most thick-walled subportion intersects with the outline of the insulator.

4. The spark plug according to claim 1 or 2, satisfying a relational expression $$0.1 \text{ mm}^2 \leq S \leq 0.35 \text{ mm}^2,$$

where, when a direction perpendicular to the axial direction is taken as a radial direction, S is an area of a region surrounded by an outline of the insulator and an imaginary line extending rearward in parallel with the axial direction from a position on the outline of the insulator corresponding to the most thick-walled subportion having the largest radial wall thickness of the diameter increase portion.

5. The spark plug according to claim 1 or 2, wherein the diameter reduction portion is formed such that it continuously extends from the support portion.

6. The spark plug according to claim 1 or 2, wherein the diameter reduction portion is formed such that a parallel portion having a predetermined length and extending in parallel with the axial direction is present between the support portion and the diameter reduction portion.

7. The spark plug according to claim 6, wherein the parallel portion is smaller in outside diameter than the most thick-walled subportion having the largest radial wall thickness of the diameter increase portion.

8. The spark plug according to claim 1 or 2, wherein the insulator has, between the diameter reduction portion and the diameter increase portion, a fixed-diameter portion whose outside diameter is fixed along a predetermined length.

9. The spark plug according to claim 1 or 2, wherein: the ledge of the metallic shell has a flat portion which extends along a predetermined length in parallel with the axial direction, and the diameter increase portion of the insulator is provided in a region which faces the flat portion.

10. The spark plug according to claim 1 or 2, wherein the diameter reduction portion and the diameter increase portion are provided such that a depression is formed frontward of the support portion.

11. The spark plug according to claim 1, wherein a curved depression is formed between the diameter reduction portion and the diameter increase portion.

12. The spark plug according to claim 1, wherein the diameter reduction portion is located adjacent to the diameter increase portion.

13. The spark plug according to claim 11, wherein the diameter reduction portion is located adjacent to the diameter increase portion.

* * * * *